US012637269B2

(12) United States Patent
Kurse et al.

(10) Patent No.: US 12,637,269 B2
(45) Date of Patent: May 26, 2026

(54) FILM SEAL ASSEMBLY AND SINGLE LID ASSAY CARTRIDGE AND ASSOCIATED METHODS

(71) Applicant: Cepheid, Sunnyvale, CA (US)

(72) Inventors: Rohan Kurse, Sunnyvale, CA (US); Douglas B. Dority, Mill Valley, CA (US); Pradeep Shivalingappa Magadum, Sunnyvale, CA (US); Kavya Umachandran, Sunnyvale, CA (US); Koua Vang, Sunnyvale, CA (US)

(73) Assignee: Cepheid, Sunnyvale, CA (US)

( * ) Notice: Subject to any disclaimer, the term of this patent is extended or adjusted under 35 U.S.C. 154(b) by 83 days.

(21) Appl. No.: 18/475,979

(22) Filed: Sep. 27, 2023

(65) Prior Publication Data

US 2024/0166411 A1 May 23, 2024

Related U.S. Application Data

(60) Provisional application No. 63/377,470, filed on Sep. 28, 2022.

(51) Int. Cl.
*B65D 51/20* (2006.01)

(52) U.S. Cl.
CPC ..... *B65D 51/20* (2013.01); *B65D 2251/0018* (2013.01); *B65D 2251/0093* (2013.01); *B65D 2577/205* (2013.01)

(58) Field of Classification Search
CPC ..... B65D 51/20; B65D 2251/0018; B65D 2251/0093; B65D 2577/205; B01L 3/527;
(Continued)

(56) References Cited

U.S. PATENT DOCUMENTS 3,673,761 A * 7/1972 Leitz ..... B29C 66/65 53/329.2
4,726,481 A * 2/1988 Hagan ..... B29C 66/73921 215/311

(Continued)

FOREIGN PATENT DOCUMENTS

WO 0222460 A1 3/2002

OTHER PUBLICATIONS

International Search Report issued in PCT Patent Application No. PCT/US2023/033867, dated Mar. 22, 2024.

(Continued)

*Primary Examiner* — Sameh Tawfik
(74) *Attorney, Agent, or Firm* — Merchant & Gould P.C.

(57) ABSTRACT

Film seal assemblies that seal one or more reagents within a sample cartridge, which allow for single lid cartridge designs. Such film seal assemblies can include one or more layers, a bottom-most layer that permanently seals with a sample cartridge having multiple chambers for one or more reagents, and top-most layer that releasably seals vent opening(s) in the film seal assembly and is removable by the end user. This configuration allows use of a single lid, which can be integrally formed with cartridge body or a separate component attached atop the cartridge body. The film seal assembly can include peelable liner(s) or can releasably attached to an underside of the single lid. Such film assemblies can include multiple layers that include a polypropylene layer for permanently sealing to a rigid propylene cartridge body and polyester top layers for releasably and hermetically sealing with a liner or the lid.

24 Claims, 15 Drawing Sheets

(58) Field of Classification Search
CPC ..... B01L 3/502715; B01L 2200/04; B01L 2300/048; B01L 2200/16
USPC ..... 53/478
See application file for complete search history.

(56) References Cited

U.S. PATENT DOCUMENTS

| | | | | |
|---|---|---|---|---|
| 5,821,073 | A * | 10/1998 | Lee | G01N 33/54388 436/514 |
| 8,968,677 | B2 * | 3/2015 | LaBorde | G01N 33/54388 435/287.7 |
| 9,414,993 | B2 * | 8/2016 | Flynn | B65B 7/16 |
| 11,072,444 | B2 * | 7/2021 | Holka | B65B 51/10 |
| 11,130,600 | B2 * | 9/2021 | Larsson | B65B 7/2807 |
| 11,208,238 | B2 | 12/2021 | Conaway | |
| 11,351,088 | B2 * | 6/2022 | Cho | B65D 65/38 |
| 11,407,545 | B2 * | 8/2022 | Bitzer | B29C 66/81457 |
| 11,450,912 | B2 * | 9/2022 | Maryanski | B60L 50/64 |
| 2007/0069054 | A1 * | 3/2007 | Shomi | C12M 45/02 241/199 |
| 2014/0378348 | A1 * | 12/2014 | Makarewicz, Jr. | B01L 3/502746 506/40 |
| 2015/0136780 | A1 | 5/2015 | Tamaro et al. | |
| 2015/0183564 | A1 * | 7/2015 | Henderson | B32B 27/32 220/359.3 |
| 2022/0219871 | A1 | 7/2022 | Yamamoto | |
| 2022/0276277 | A1 * | 9/2022 | Tanimoto | B01L 3/502715 |
| 2022/0289448 | A1 * | 9/2022 | Dinauer | A61B 50/30 |
| 2025/0162226 | A1 * | 5/2025 | Nishio | B32B 5/18 |

OTHER PUBLICATIONS

Written Opinion issued in PCT Patent Application No. PCT/US2023/033867, dated Mar. 22, 2024.

* cited by examiner

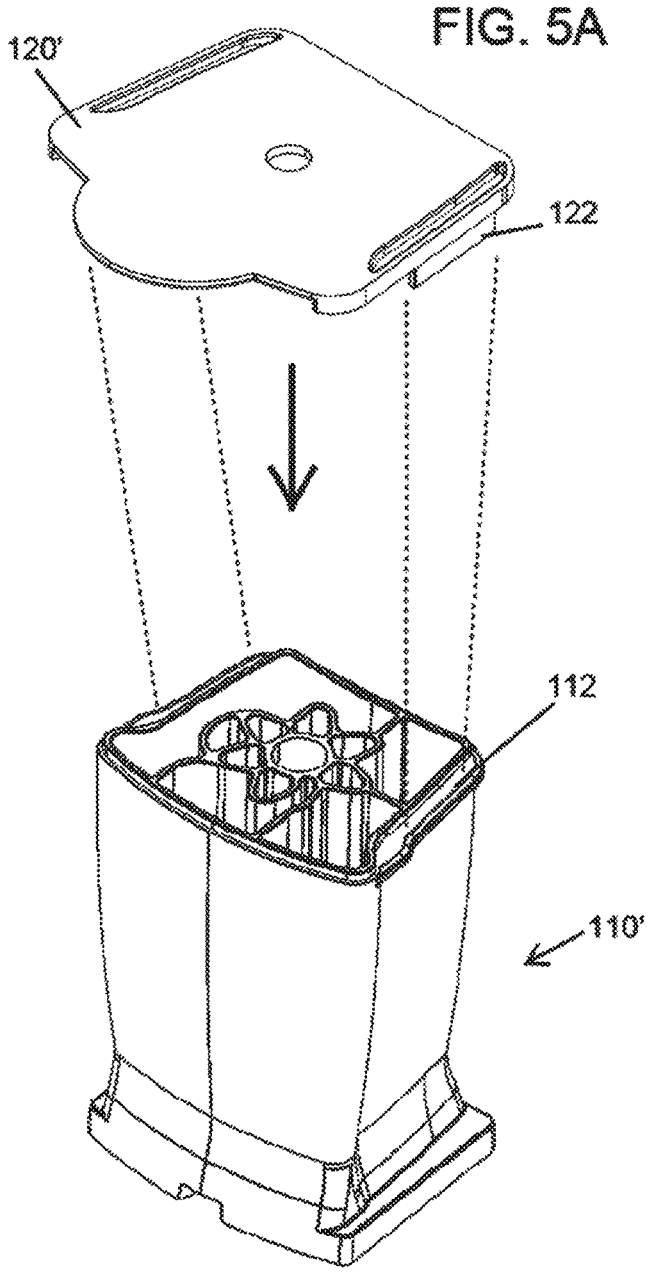
FIG. 5A
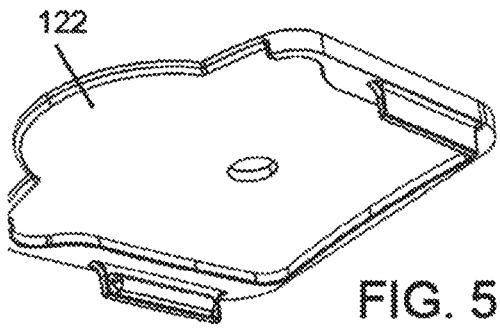
FIG. 5B
FIG. 5C

FILM SEAL ASSEMBLY AND SINGLE LID ASSAY CARTRIDGE AND ASSOCIATED METHODS

CROSS-REFERENCES TO RELATED APPLICATIONS

This application is a Non-Provisional of and claims the benefit of priority of U.S. Provisional Application No. 63/377,470 filed Sep. 28, 2022, the entire contents of which are incorporated herein by reference.

FIELD OF THE INVENTION

The present invention relates generally to the field of manufacturing of biological equipment, in particular diagnostic assay sample cartridges for analysis of a fluid sample.

BACKGROUND OF THE INVENTION

In recent years, there has been considerable development in the field of biological testing devices that facilitate manipulation of a fluid sample within a sample cartridge for biological testing of a fluid sample by polymerase chain reaction (PCR). One notable development in this field is the GeneXpert® sample cartridge by Cepheid. The configuration and operation of these types of cartridges can be further understood by referring to U.S. Pat. No. 6,374,684 entitled "Fluid Control and Processing System," and U.S. Pat. No. 8,048,386 entitled "Fluid Processing and Control." While these sample cartridges represent a considerable advancement in the start of the art, as with any precision instrument, there arise certain challenges in regard to manufacturing as well as user workflow. In particular, the assembly of multiple components in a precision, pressurized instrument requires assembly of many complex components, which represents significant cost burden and requires complex assembly techniques that can introduce potential defects and additional manufacturing challenges.

Conventional systems for manufacturing sample cartridges utilize a series of manufacturing process and steps, to ensure proper sealing of chambers of the sample cartridge containing one or more reagents. Some such cartridges include steps, such as ultrasonic welding of a double-lid apparatus onto a cartridge body and sealing of reagents within the cartridge. The double-lid apparatus includes a lower lid that is ultrasonically welded atop the sample cartridge and an upper lid this closes over the lower lid. An additional film seal can be used after depositing one or more reagents in the chambers to seal the reagents within the cartridge. The top lid closes over the bottom lid and film seal, thereby securing the reagents within the chambers during storage and transit to the end user. While these techniques have achieved sample cartridges with performance that far surpasses conventional sample cartridges, the current designs still present certain challenges in regard to cost and complexities in manufacturing and assembly, which in turn introduce potential sources of defects and significant cost burden.

Accordingly, there exists a need for improved designs that avoid the complexities of the current double-lid design and associated potential defects and reduce the cost burden associated with cartridge components. There is further need for such improvements that maintain or further improve sealing within the sample cartridge and reliability of performance.

BRIEF SUMMARY OF THE INVENTION

In one aspect, the invention pertains to a method of sealing a sample cartridge. Such methods can include steps of: placing a film seal assembly atop a cartridge body of a sample cartridge having multiple chambers defined therein, the multiple chambers including one or more reagent chambers and a sample chamber; permanently sealing a bottom surface of the film seal assembly along top edges of the cartridge body, where the film seal assembly includes one or more vent openings defined therein for venting one or more of the reagent chambers; and releasably and hermetically sealing the one or more vent openings by a top surface of the film seal assembly so as to seal the one or more reagent chambers during storage and/or transport to the user, where the seal assembly is configured to facilitate release of the hermetic seal by the end user. The vent and access openings can be laser cut or made by any suitable means. As described herein permanently sealing or permanent seals can also be referred to as "welding" or "welds," which can include heat sealing and/or adhesive sealing. It is appreciated that any of the methods described herein can include variations of one or more steps or could include one or more intervening steps or additional steps not described here.

In some embodiments, permanently sealing includes sealing the bottom surface of the film seal assembly along a top edge of the cartridge body circumscribing the one or more reagent chambers, such as by heat sealing, induction sealing, adhesive sealing or any suitable sealing means. In some embodiments, the heat sealing may also utilize an adhesive. The methods can further include securing a single lid of the cartridge atop the film seal assembly, where the single lid is removable and/or movable between an open and closed position in which the single lid is secured atop the film assembly. In some embodiments, the single lid is integrally formed with the cartridge body, which can be further advantageous in improving workflow by improving peelability of one or more layers of the film seal assembly. In other embodiments, the single lid is a separate component from the cartridge body and is releasably coupled to the cartridge body. In either case, the single lid can be releasably secured atop the cartridge body by corresponding snap-fit features, latch, closure mechanism or any suitable coupling means.

In some embodiments, the film seal assembly comprises at least two separable layers, a top layer and a bottom layer. Methods of sealing utilizing such assemblies can include providing a releasable hermetic seal by heat sealing and/or adhesively sealing the top layer to the bottom layer. The bottom layer can include one or more sub-layers. In some embodiments, the bottom layer includes at least a bottom-most sub-layer including polypropylene for permanently sealing to the cartridge body, when the cartridge body is formed of rigid polypropylene. The bottom layer can further include a top-most layer of polyester for releasably sealing to the separable top layer and/or providing heat resistance to the bottom layer. In some embodiments, the separable top layer is an adhesive liner formed of polyester. In some embodiments, the top layer includes one or more tabs that extend forward beyond a perimeter of the top of the cartridge body to facilitate manual grasping by the user to remove the liner. In such embodiments, the single lid releasably coupled atop the cartridge body can include a front tab that extends beyond the perimeter of the top of the cartridge body to facilitate manual grasping by the user to remove the liner while opening the single lid. In some embodiments, the film seal assembly includes an adhesive layer (e.g. double-sided adhesive strip) that may extend partly or fully across the top layer to secure the top layer to the lid so that when the lid is opened the top layer peels away from the film seal assembly.

In some embodiments, the film seal assembly includes a single layer in which the top surface releasably seals with a lid of the sample cartridge and the bottom layer is configured to permanently seal with the cartridge body. The single layer can include one or more adhesives disposed thereon. In some embodiments, the single layer includes at least two non-separable sub-layers, where the bottom layer comprises a first material for permanently heat sealing to the cartridge body and the top sub-layer comprises a second material different than the first, the second material selected for releasably sealing to a lid of the sample cartridge. In some embodiments, the top surface is releasably sealed by applying pressure to the lid so that a pressure-sensitive adhesive disposed on the top surface hermetically seals the lid to the top surface of the assembly. The top surface can be releasably sealed by heat sealing.

In another aspect, the invention pertains to a film seal assembly for sealing atop a cartridge body of a sample cartridge having multiple chambers including one or more reagent chambers for holding one or more reagents for analytical testing of a fluid sample inserted into the sample cartridge. Such film seal assemblies can include: one or more layers disposed within a planar assembly, where each of the one or more layers are planar and shaped so as to cover a perimeter of a top edge of the cartridge body. In some embodiments, the planar assembly includes a top surface and a bottom surface, where the bottom surface is configured for permanently sealing along the top edge of the cartridge body so as to cover the multiple chambers defined therein, the film seal assembly having one or more vent openings extending at least partly therethrough for venting of the one or more reagent chambers, and the top surface configured for releasably and hermetically sealing the one or more vent openings so as to hermetically seal the one or more reagent chambers for storage and/or transport to an end user.

In some embodiments, the film seal assembly comprises at least two separable layers including a top layer and a bottom layer. The releasable seal can include a heat seal and/or an adhesive seal with the bottom layer. In some embodiments, the top layer comprises polyester and can be configured as a peelable adhesive liner. The bottom layer can include one or more non-separable sub-layers and the one or more vent openings extend through the bottom layer. In some embodiments, the bottom layer can include at least a bottom-most sub-layer including polypropylene for permanently heat sealing to a cartridge body formed of rigid polypropylene. The bottom layer can further include a top-most sub-layer including polyester for releasably sealing to the separable top layer. In some embodiments, the film assembly is defined as a single layer. The single layer can include one or more adhesives thereon to facilitate permanently sealing with the cartridge body and/or releasable sealing with a lid of the sample cartridge. In some embodiments, the top surface is configured to releasably seal by an adhesive and/or by heat sealing. The single layer can include at least two non-separable sub-layers including a bottom sub-layer having a first material for permanently heat sealing to the cartridge body and a top sub-layer of a second material different than the first, the second material selected for releasably sealing to the lid. In some embodiments, the top-most layer includes polyester and the bottom-most layer includes polypropylene.

In yet another aspect, the invention pertains to an improved sample cartridge design. The sample cartridge can include: a cartridge body having multiple chambers defined therein, where the multiple chambers include a sample chamber for receiving a fluid sample and one or more reagent chambers for storing one or more reagents for performing analytical testing of the fluid sample, where the multiple chambers are open along a top of the cartridge body; and a lid is attached to and covers the top of the cartridge body and multiple chambers. Such sample cartridges are well suited for use with the improved film seal assemblies described herein. Such film seal assemblies can include an assembly having at least two separable layers including: a bottom layer with the bottom surface configured for permanently sealing atop the cartridge body, the bottom layer having the one or more vent openings defined therein; and a top peelable layer disposed over the bottom layer that hermetically seals the one or more vent openings in the bottom layer, the top peelable layer being removable by the end user. In some embodiments, the top layer includes a polyester liner and the bottom layer includes polypropylene. In some embodiments, the bottom layer has multiple non-separable sub-layers including: a bottom-most sub-layer including polypropylene for permanently sealing to the cartridge body, and a top-most sub-layer including polyester for releasably and hermetically sealing to the polyester liner. It is appreciated that the film seal assemblies can be applied to any suitable sample cartridge, including unibody, unitary cartridges having an integral lid or conventional cartridges with a separate lid, and that the assembly process can be partly or fully automated. Suitable film seal assemblies can also include an assembly having a single layer, such as any of those described herein.

In another aspect, the invention pertains to a method of using a sample cartridge that is sealed by a film seal assembly having at least top and bottom layers that are separable. Such methods can include steps of: opening a lid of the sample cartridge, which in turn, peels a top layer of the films seal assembly, thereby exposing the bottom layer of the film assembly sealed to a top of the cartridge body, the film seal assembling having one or more openings corresponding to a sample chamber and one or more reagent chambers; inserting a biological sample into a sample chamber of the through an opening of the one or more openings into the sample chamber; and closing the lid of the sample chamber, thereby sealing the sample container for subsequent testing. In some embodiments, the film seal assembly can include an additional auxiliary opening over a reagent chamber to allow a user to insert a specialized reagent. In some embodiments, the film seal assembly comprises an adhesive layer disposed atop the top layer so as to secure the top layer to the lid so that when the lid opens, the top layer peels away from the bottom layer of the film seal assembly. In some embodiments, at least the top layer and the adhesive layer include a forwardly projecting tab that extends forward from the periphery of the top of the cartridge body corresponding to a forwardly projecting tab of the lid so as to facilitate peeling away of the top layer when the lid is opened. In some embodiments, the lid is opened manually by a user. In some embodiments, the lid is opened robotically by an automated system.

BRIEF DESCRIPTION OF THE DRAWINGS

FIGS. 5A-5C shows another embodiment having a single lid that is fabricated separately and attaches to a conventional cartridge body in accordance with some embodiments.

DETAILED DESCRIPTION OF THE INVENTION

Figure 1A:
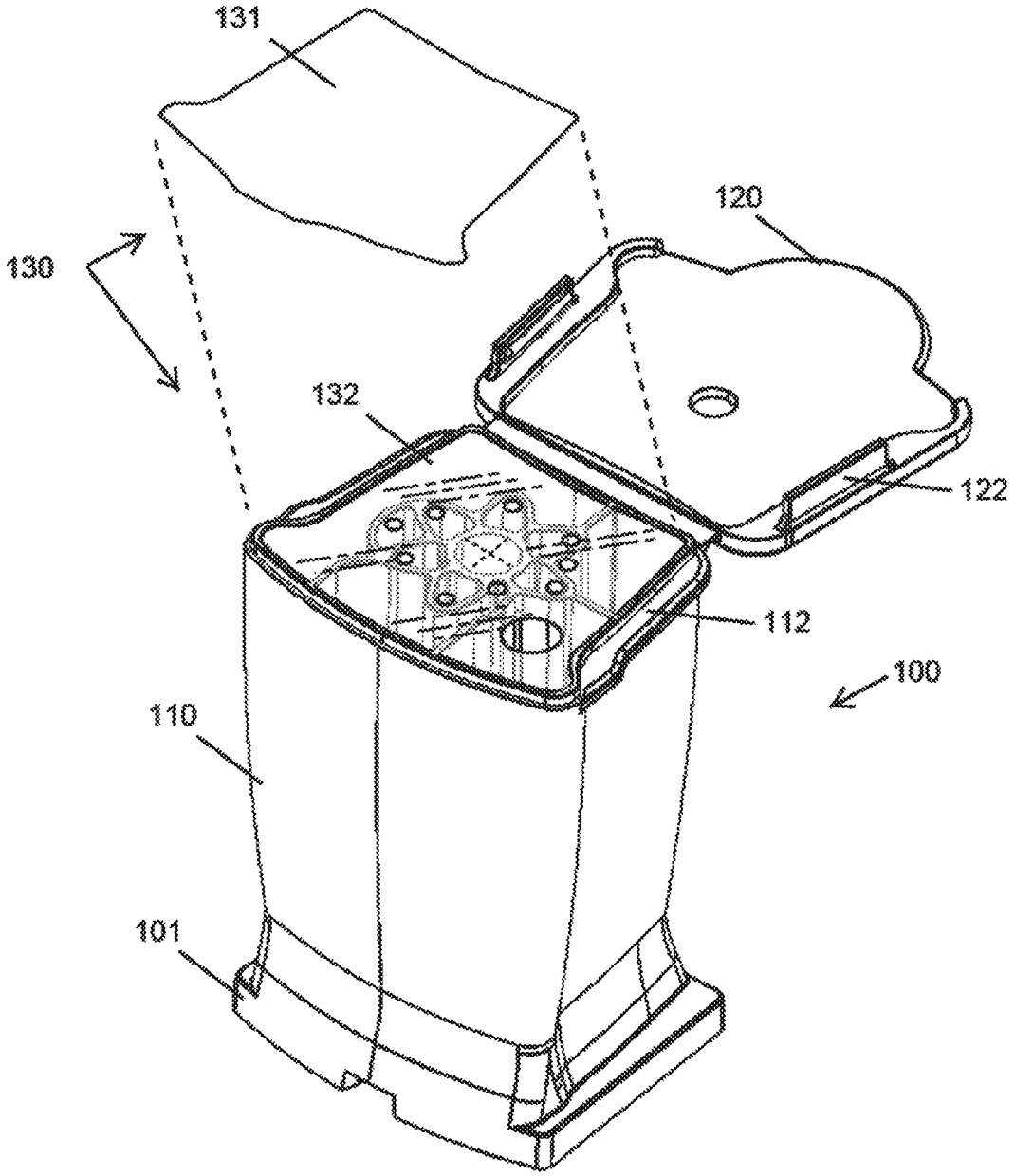
FIGS. 1A-1B shows exemplary diagnostic assay cartridges with improved film seal assembly in accordance with some embodiments.

The present invention relates generally to improved sample cartridges and film sealing assemblies and associated methods of use, sealing and assembly. In particular, the sample cartridge and film sealing assembly designs described herein seek to improve upon the current cartridge designs and sealing approaches that rely on a double-lid design, which has a high-cost burden at the manufacturing and component level and introduces sources of potential defects, as described in further detail below. The designs and methods described herein overcome these challenges by providing seal assemblies that can utilize a more reliable heat-sealing method and can utilize less costly raw materials (e.g. films rather than injection molded components) and that further avoid the complexities of current designs and avoid the drawbacks associated with current assembly techniques such as ultrasonic welding.

I. System Overview

In one aspect, the invention pertains to improved film seal assemblies that facilitate welding (i.e. permanent attachment directly to the cartridge body) and releasable hermetic sealing of one or more vent openings defined in the film seal assembly. Such a configuration allows the sample cartridge to maintain a hermetic seal of one or more reagents disposed within one or more chambers within the sample cartridge during storage and/or transit to an end user, after which the end user can release the hermetic seal, inject the fluid sample into the sample chamber and perform analytical testing of the sample. These improved film seal assemblies can include a bottom surface that permanently attaches to the top of the cartridge body and a top surface that releasably and hermetically seals one or more vent openings in the film assembly.

Such film assemblies can be of varying configurations, including a single layer design and multi-layer designs with or without peelable liners, such as described in further detail below. These film assemblies further allow for improvements of other sample cartridge components, by obviating the need for the double-lid design. The film seal assembly effectively replaces the functionality of the bottom lid, such that the double-lid design can be replaced with a simplified single lid, which can be manufactured as a separate component or can be integrally formed along with the cartridge body. This is advantageous as it reduces the cost burden of componentry and further avoids the need for ultrasonic welding, which can be damaging to various components within the sample cartridge and which is a potential source of defects. A key benefit of the design herein is the flexibility of using film seals instead of an ultrasonically welded lid when making changes to the cartridge chamber geometry. Advantageously, changes to the geometry of cartridge chambers do not require changes to the lid and lid mold to match the cartridge body since design and use of film seals is not dependent on that geometry.

In some embodiments, the film seal assembly is a two-film seal assembly, for example a bottom lock/weld layer and a top removable liner layer that hermetically seals the assembly atop the cartridge. Identifying a two-film seal system that can consistently peel was performed by use of pressure and laser cutting systems. In some embodiments, the top liner film includes forward extending tabs that can be tacked on to a front tab of the single lid to allow for a single cartridge opening step workflow by the user.

II. Film Seal Assemblies and Single-Lid Cartridges

FIG. 1A shows an example film seal assembly 130 that allows for an improved sample cartridge design 100 having a cartridge body 110 formed integrally with a single lid 120. The sample cartridge further includes base 101, which can be formed separately and attached to the cartridge body or formed integrally with the cartridge body. In this embodiment, the film seal assembly 130 has a two-layer design, which includes a top layer 131 and a bottom layer 132. The bottom layer 132 is permanently sealed (e.g. welded), such as by adhesive and/or heat sealing, to the top edge of the cartridge body 110. The bottom layer include one or more vent openings that vent the chambers to allow a fluid sample to flow through the chambers during processing with a sample processing module that receives the sample cartridge and performs analytical testing of the sample. The shape, vent openings and sample chamber access can be laser cut or made by any suitable means. The top layer 131 releasably attaches to the bottom layer 132 so as to hermetically seal the vent openings in the bottom layer. In this embodiment, the top layer 131 is a peelable layer that is removed by the end user, as shown, to allow venting of the chambers and access to the sample chamber for insertion of the fluid sample (lower right). The integrated single lid 120 is then closed and the sample cartridge 100 is inserted into a sample processing/analytical testing module (not shown) for processing and analytical testing. In this embodiment, the lid and top of cartridge body includes corresponding snap-fit features, namely resilient tabs 122 on each lateral side of the lid 120 that snap-fit into corresponding contours 112 defined along lateral sides of the top of the cartridge. It is appreciated that these features could be reversed or of various other sizes, shapes, locations.

Figure 1B:
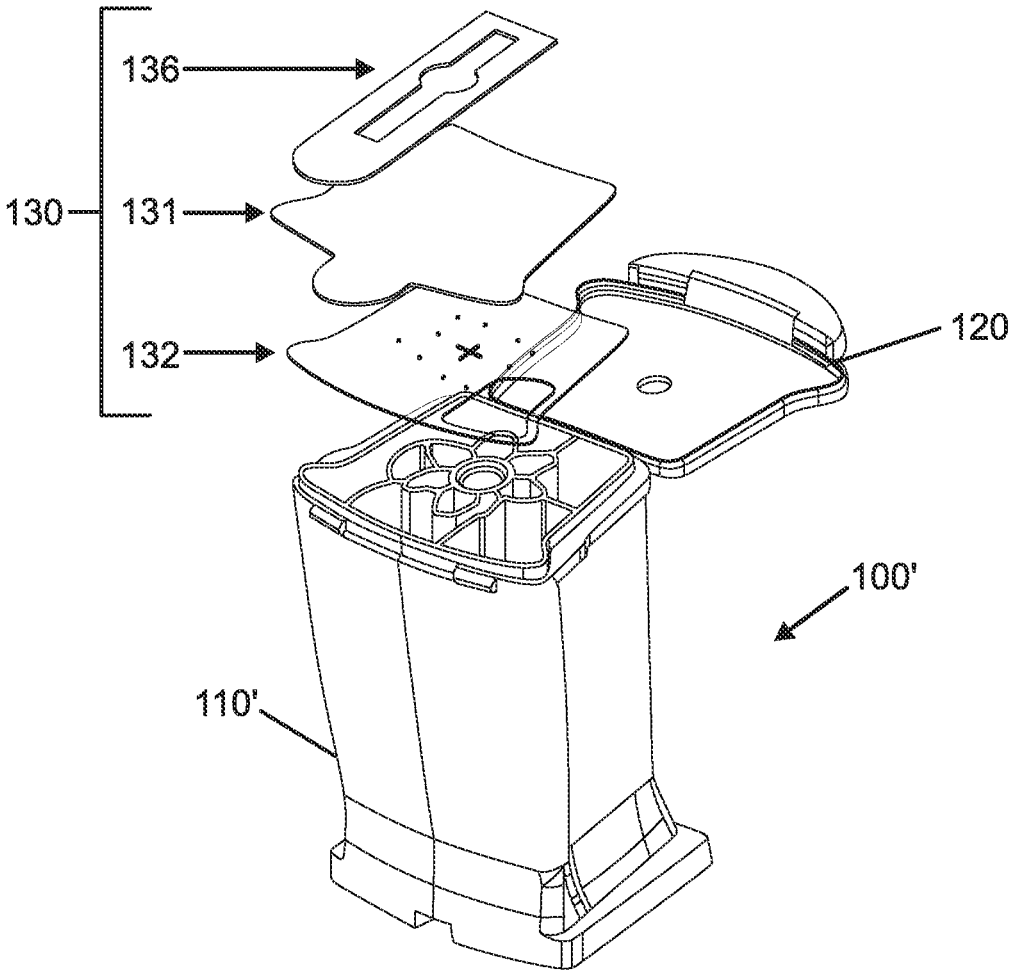

FIG. 1B shows another film seal assembly 130 for sealing atop an improved sample cartridge design 100' having a cartridge body 110' with an integral lid 120. Similar to the previous embodiment, the film seal assembly 130 includes a top layer 131 and a bottom layer 132, but this embodiment further includes an adhesive layer 136 tab that secures the top layer 131 to the underside of the lid to facilitate peeling away of the top layer upon manual opening of the lid. In some embodiments, the adhesive tab layer comprises a double-sided adhesive layer having adhesive (e.g. pressure-contact adhesive) on both sides. See an example construction in FIG. 11C. As shown, the top layer 131 includes a forwardly projecting tab that extends further beyond the periphery of the perimeter of the cartridge top and under the front tab of the lid when closed so that a user manually opens the lid by pressing upwards along the front tab of the lid, the manual action also engages the forwardly projecting tabs and peels back the top layer of the film seal assembly. In this embodiment, the cartridge includes same or similar parts as those detailed above in FIG. 1A, except the cartridge body design has a slightly different shape and snap-fit features, as detailed further below in FIG. 14. In this embodiment, the lid and top of cartridge body includes corresponding snap-fit features that include contoured cut-outs in the lid that snap into a single resilient tab disposed along the front of the cartridge body. It is appreciated that the film seal assemblies could be used with any of the cartridges described herein (e.g. unitary or unibody cartridge) or even conventional cartridges. In this embodiment the bottom layer is a lock seal film that is heat sealed on the cartridge and that includes vent holes and a sample chamber cutout and plunger cut perforations at center, which can be laser cut or formed by any suitable means. The top film is an easy peel film that is sealed on top of the bottom layer and which includes the plunger cut perforations at center. The top film can be sealed to the bottom layer by heat sealing, induction, adhesive sealing or any suitable means. The additional adhesive layer 136 can be defined in any suitable shape, and is not required to cover the entire top layer. In this embodiment, it is formed in an elongated tab shape that is laser cut with a central opening or slot for passage of the plunger. In some embodiments, the adhesive layer is defined, as shown in FIG. 11C with an adhesive layer 138 between two release liner layers 139, which is then laser cut into the desired shape (e.g. tab shape with central slot). One liner is peeled off and the adhesive layer is applied to the top layer of the film seal assembly and then the other liner is peeled off to expose the adhesive layer and the lid is closed to initiate bonding to secure the top layer of the film assembly to the lid so that when the user opens the lid, the top lid peels away from the bottom layer. This configuration further simplifies the workflow as compared to embodiments without this adhesive layer that would require the user peel away an additional liner. It is appreciated that some or all of these assembly aspects can be performed by an automated system.

Advantageously, this design obviates the need for the bottom lid of the double-lid design, such that the double-lid has been replaced by a single lid that closes atop the film seal assembly (or atop the bottom layer after removal of the peelable top layer). Accordingly, as the lid design has been greatly simplified, the single lid can be included as an integrally formed portion of the cartridge body. This design is advantageous as it not only reduces the cost burden of components, but avoids the need for ultrasonic welding of the lid to the cartridge to effect sealing, and relies primarily on the film assembly for sealing of the reagents therein.

Figure 2A:
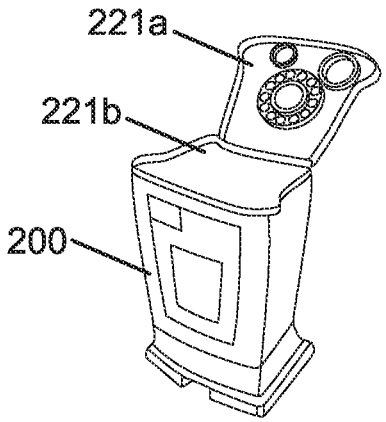
FIG. 2A (Prior Art)
FIG. 2A illustrates a conventional sample cartridge having a welded double-lid apparatus and film seal, as provided to the user, with the lid in the top lid open for receiving a fluid sample.

The above use and advantages of the improved film seal assembly and cartridge design with single lid can be further appreciated by referring to the conventional cartridge design that relies on a conventional double-lid device apparatus, as shown in FIGS. 2A-2A. In this conventional design, the sample cartridge 200 includes a separated double-lid apparatus 220 that is ultrasonically sealed atop the cartridge body 200 that holds the reagents and fluid sample. The double-lid apparatus 220 includes a bottom lid portion 221*b* that is sealed to the cartridge body and a top lid portion 221*a* that flips open, as shown in FIG. 2C, to allow the user to deposit the fluid sample in the cartridge. The sample cartridge 200 is provided to the user having reagents already disposed within selected chambers and sealed within the cartridge by a thin film (not shown) that is sealed atop the bottom lid 221*a*. Apart from the integrated lid and the film seal assembly, the other parts of the sample cartridge body described herein (e.g. chambers, valve body, reaction tube, base, etc) can remain the same as in this conventional cartridge design such the cartridge can be improved upon without requiring any modification of the module operation.

Figure 2B:
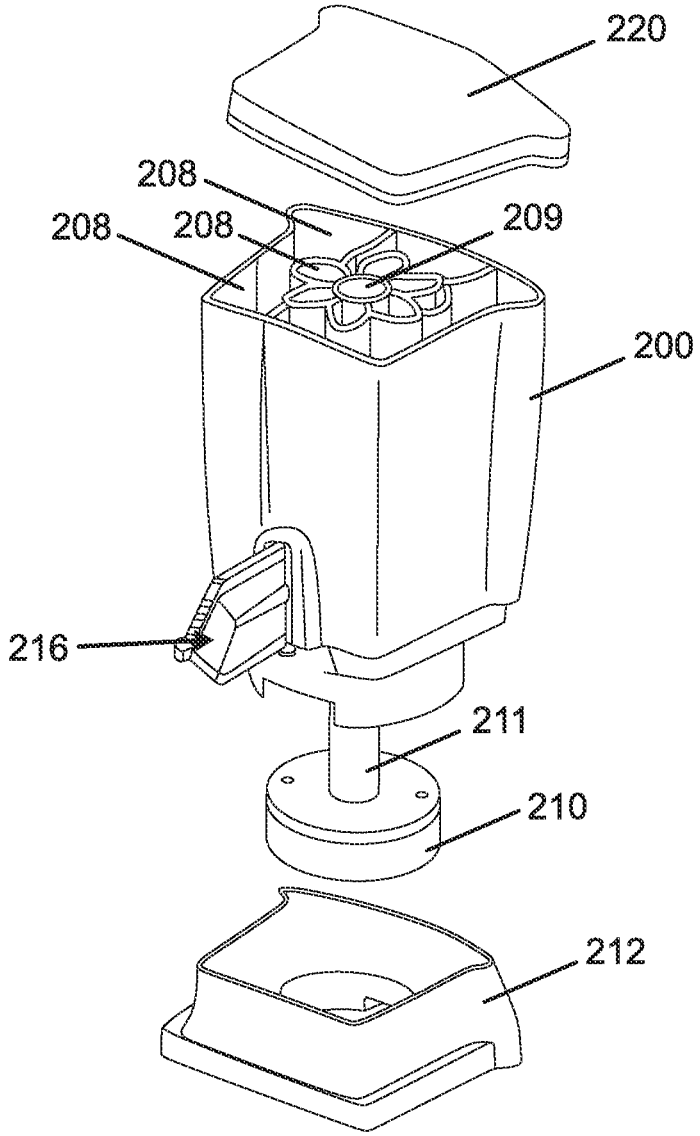
FIG. 2B (Prior Art)
FIG. 2B illustrates an exploded view of the conventional sample cartridge illustrating its major components, including the double-lid apparatus, multi-chamber body, reaction vessel, valve assembly and base.

FIG. 2B depicts an exploded view of a conventional cartridge design utilizing a double-lid apparatus. The illustrated cartridges are based on the GENEXPERT® cartridge (Cepheid, Inc., Sunnyvale, Calif.). The cartridge 200 includes a cartridge body having multiple chambers 208 for holding various reagent and/or buffers. The chambers are disposed around a central syringe barrel 209 that is in fluid communication with valve body 210 through valve syringe tube 211 extending through the syringe barrel 209. The valve body 210 is interfaced within the cartridge body and supported on a cartridge base 212. The cartridge typically contains one or channels or cavities that can contain a filter material (e.g. glass filter column) that can function to bind and elute a nucleic acid. In various embodiments, the cartridge further comprises one or more temperature controlled channels or chambers that can, in certain embodiments, function as thermocycling chambers. A "plunger" of the module (not shown) can be operated to draw fluid into the syringe barrel 209 and rotation of the valve body/syringe tube provides selective fluid communication between the various reagent chambers and channels, reaction chamber(s). Thus, the various reagent chambers, reaction chambers, matrix material(s), and channels are selectively in fluid communication by rotation of the valve and plunger and reagent movement (e.g., chamber loading or unloading) is operated by the "syringe" action of the plunger. The attached reaction vessel 216 ("PCR tube") provides optical windows to provide real-time detection of, e.g., amplification products, base identity in sequencing operations, by operation of the module within the system described herein. It is appreciated that such a reaction vessel could include various differing chambers, conduits, or micro-well arrays for use in detecting the target analyte. The sample cartridge can be provided with means to perform preparation of the biological fluid sample before transport into the reaction vessel. Any chemical reagent required for viral or cell lysis, or means for binding or detecting an analyte of interest (e.g. reagent beads) can be contained within one or more chambers of the sample cartridge, and as such can be used for sample preparation.

An exemplary use of such a sample cartridge with a reaction vessel for analyzing a biological fluid sample is described in commonly assigned U.S. Pat. No. 6,818,185, entitled "Cartridge for Conducting a Chemical Reaction," filed May 30, 2000, the entire contents of which are incorporated herein by reference for all purposes. Examples of the sample cartridge and associated instrument module are shown and described in U.S. Pat. No. 6,374,684, entitled "Fluid Control and Processing System" filed Aug. 25, 2000, and U.S. Pat. No. 8,048,386, entitled "Fluid Processing and Control," filed Feb. 25, 2002, the entire contents of which are incorporated herein by reference in their entirety for all purposes. Various aspects of the sample cartridge can be further understood by referring to U.S. Pat. No. 6,374,684, which described certain aspects of a sample cartridge in greater detail. Such sample cartridges can include a fluid control mechanism, such as a rotary fluid control valve, that is connected to the chambers of the sample cartridge. Rotation of the rotary fluid control valve permits fluidic communication between chambers and the valve so as to control flow of a biological fluid sample deposited in the cartridge into different chambers in which various reagents can be provided according to a particular protocol as needed to prepare the biological fluid sample for analysis. To operate the rotary valve, the cartridge processing module comprises a motor such as a stepper motor typically coupled to a drive train that engages with a feature of the valve to control movement of the valve in coordination with movement of the syringe, thereby resulting in movement of the fluid sample according to the desired sample preparation protocol. The fluid metering and distribution function of the rotary valve according to a particular sample preparation protocol is demonstrated in U.S. Pat. No. 6,374,684. It is appreciated that the lid concepts herein can be utilized in a unitary cartridge body ("unibody"), such as any of those described in U.S. application Ser. No. 18/184,326 filed Mar. 15, 2023, the entire contents of which are incorporated herein by reference for all purposes. It is further appreciated that the lid concepts herein can also be utilized in conventional cartridges.

Figure 2E:
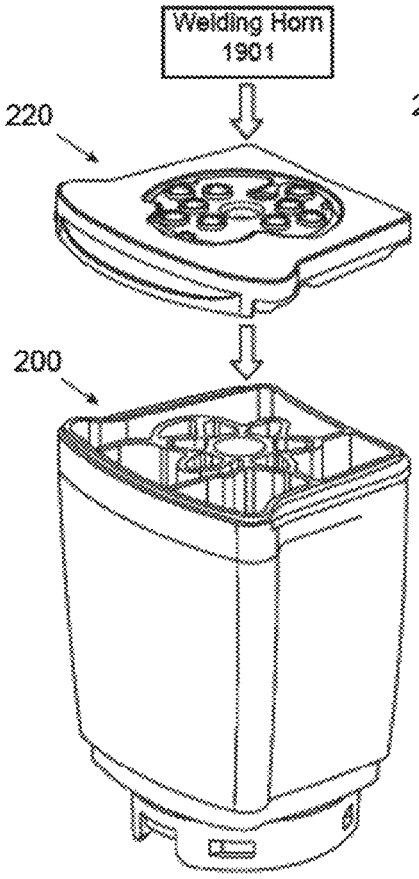
FIG. 2E (Prior Art)
FIG. 2E shows the double-lid apparatus before placement atop the sample cartridge body for ultrasonic welding by the welding horn.
Figure 2C:
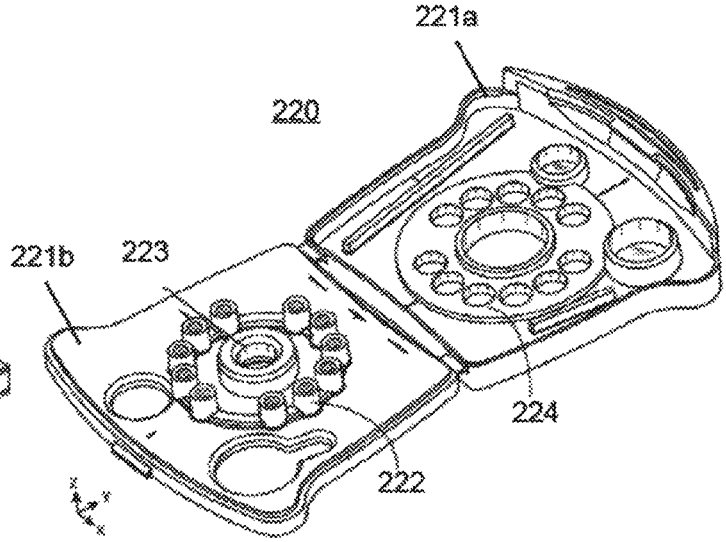
FIGS. 2C-2D show a detail view of the double-lid apparatus.
Figure 2D:
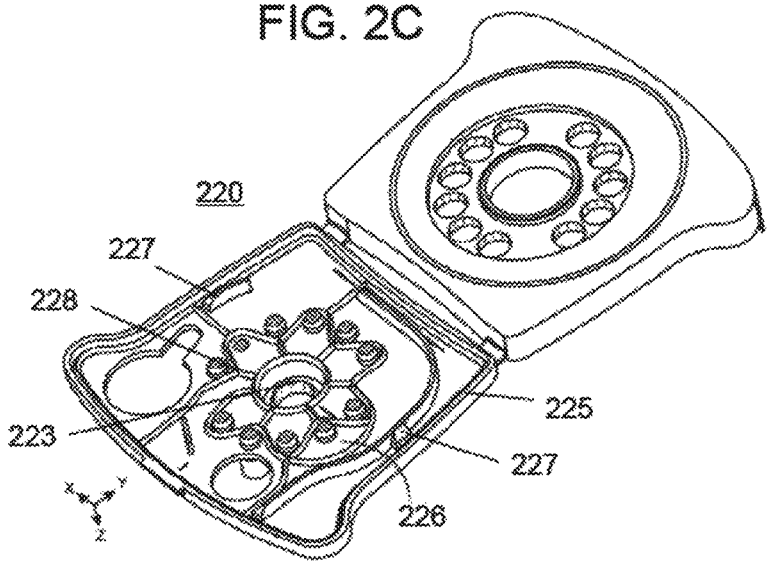
FIG. 2D (Prior Art)

FIGS. 2C-2D shows detailed views of the conventional double-lid apparatus 220, which includes the top lid 221*a* and bottom lid 221*b*. The chambers of the fluid container apparatus disclosed herein container apparatus disclosed herein can contain one or more reagents for a variety of purposes. These reagents maybe present in a variety of forms. Non-limiting exemplary reagent forms can include a solution, a dry powder, or a lyophilized bead. The reagents may be intended for different purposes including but not limited to chemical and/or enzymatic reactions, sample preparation, and/or detection. Non-limiting exemplary purposes can include lysis of cells or microorganisms, purification or isolation of an analyte of interest (e.g., a specific cell population, a nucleic acid or a protein), digestion or modification of nucleic acids or proteins, amplification of nucleic acids, and/or detection of an analyte of interest. Additional details of the lid apparatus can be found in U.S. Pat. No. 10,273,062, the entire contents of which are incorporated herein by reference.

FIG. 2C shows a top view of the lower-side of bottom-lid and underside of the top-lid portion. The lower-side of bottom-lid includes multiple chimneys 222 that protrude upwards from the top surface of the bottom-lid portion and are received in corresponding holes 224 in the top-lid portion. The chimneys 222 and openings 224 surround a central opening 223 through which a syringe instrument of the module extends during operation of the sample cartridge therein to facilitate fluid flow between the chambers by movement of the valve body. FIG. 2D shows a bottom view of the lower-side of bottom-lid of the double-lid apparatus 220, which includes a lower-side main surface, and a top-side of the top-lid portion. The underside of the bottom-lid portion is ultrasonically welded onto the top edge of the cartridge body. To facilitate ultrasonic welding, a raised welding ridge 225 is continuous about the periphery of the bottom-lid, between the edge alignment features 227 and the outermost wall. When seated in a proper fashion, the edge alignment features 227 and outermost walls prevent excessive rotation of the bottom-lid against the fluid container 200, thus aligning the raised welding ridge 225 of the bottom-lid with weldable features (e.g., top edges of walls) of the cartridge body. Walls 227 extend from a central portion of the lower-side main surface and are patterned in a flower petal-like arrangement, about the central opening 228 around which a cylindrical wall 223 extends. A raised welding pattern is present on the top edges of the walls. The raised welding pattern connects to the welding ridge 225. When a fluid container and the bottom-lid are welded via the raised welding pattern and welding ridge, sub-containers within the bottom container are fluidly isolated from one another.

FIG. 2E shows the double-lid apparatus 220 in relation to the cartridge body 200. The cartridge body 200 contains multiple chambers that can be fluidly coupled or non-coupled according to the position of an internal valve assembly. The chambers are defined by walls that extend to the top of the cartridge body 200. The fused interface between the lid apparatus 220 and the cartridge body 200 is created such that the chambers are sealed off from one another by way of a welded interface between the raised welding pattern 160 and welding ridge 156 and the chambers of the container 200. The lid apparatus 220 is welded to the fluid container by way of an ultrasonic welding horn 1901 that interfaces with the plateau while the apparatus is seated on the container 200. The welding horn 1901 generally comprises a metal cylinder shaped to interface against and around the plateau. The welding horn is part of a greater welding apparatus (not shown) which provides energy to the horn. Typically, the welding operation described above is performed at a welding station along the manufacturing/production line.

Thus, as can be appreciated, the conventional double-lid apparatus 220 includes a number of relatively complex features (e.g. chimneys, plateaus, etc.) such that it is necessary to form the double-lid apparatus as a separate injection-molded component, which must then be securely attached to the cartridge body. To ensure a suitable seal of the bottom lid portion with the cartridge body, ultrasonic welding is used, which can introduce damage to various components and is source of potential defects during cartridge manufacturing, all of which is avoided by the improved film seal design allowing for a greatly simplified single lid design.

A. Example Sample Cartridge with Single Lid Design

Figure 3A:
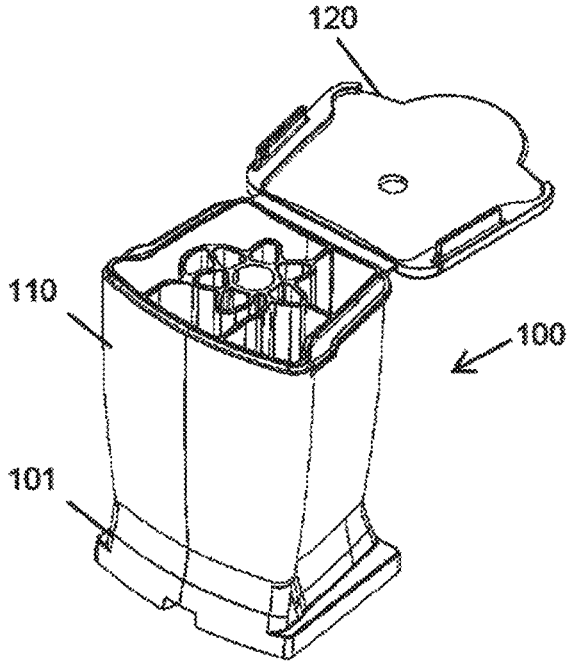
FIGS. 3A-3C shows an exemplary diagnostic assay cartridge body with integrated single lid in accordance with some embodiments.
Figure 3B:
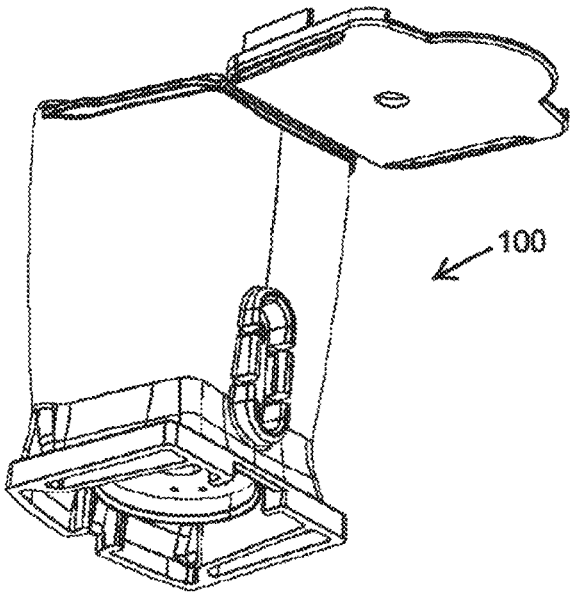
Figure 3C:
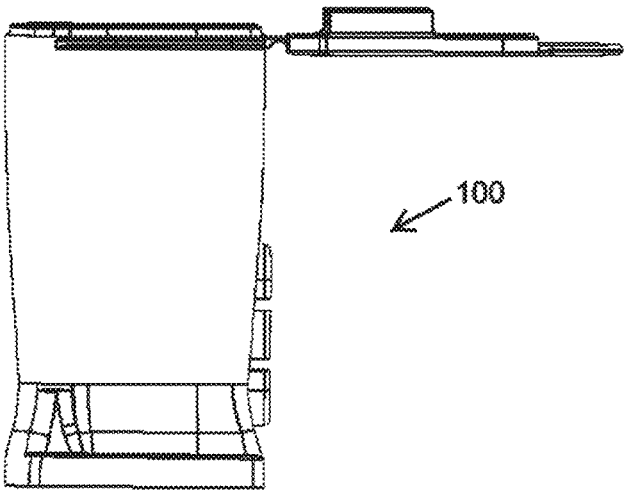

FIGS. 3A-5C show improved sample cartridge designs having a single lid suited for use with the film seal assemblies described herein. FIGS. 3A-3C show various view of an improved sample cartridge 100 having a single lid 120 that is integrally formed with the cartridge body 110 (shown before application of any film seal assembly). As can be seen in the side view of FIG. 3C, the single lid 120 is attached to the cartridge body 110 by a living hinge, which is a thinned portion of material that allows the lid to flip between an open position, as shown, to receive the fluid sample and a closed position for processing of the sample cartridge in the module. In some embodiments, the other aspects of the cartridge (e.g. chambers, syringe tube, sample chamber) are the same as a conventional cartridge such that the module can perform sample processing in an identical manner as a conventional cartridge.

Figure 4A:
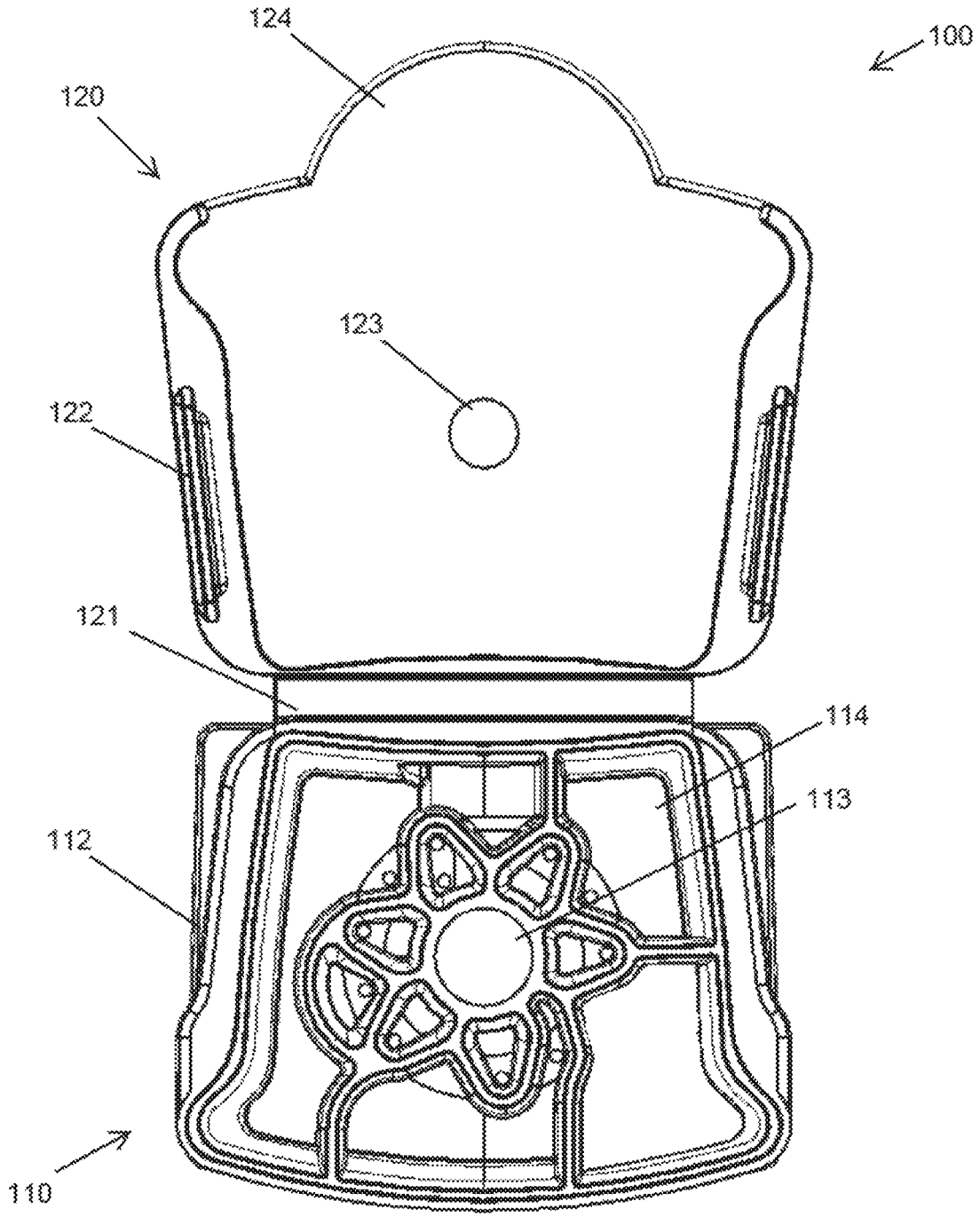
FIGS. 4A-4B shows a top view of the multiple chambers of the assay cartridge body in FIG. 3A before and after application of a film seal in accordance with some embodiments.
Figure 4B:
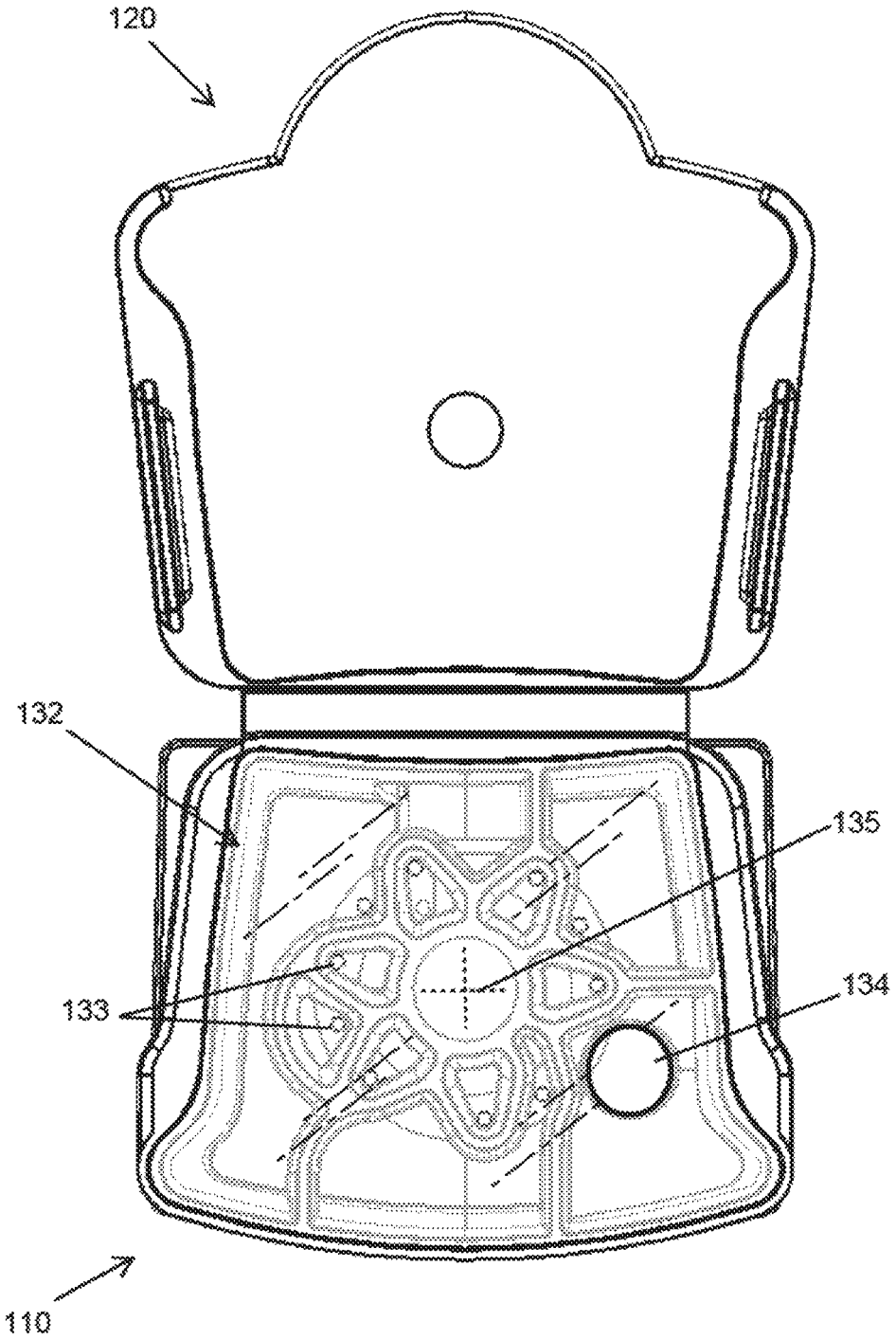

FIGS. 4A-4B show the improved sample cartridge 100 with single integral lid 120 before and after application of an improved film seal assembly 130, respectively. In FIG. 4A, the single integrated lid 120 is shown in the open position showing a top view of the internal chambers of the cartridge body 110. The lid 120 includes a central hole 123 for passage of the syringe/plunger of the module and a forward extending tab 124 to facilitate manual opening and closing of the lid by the user. The chambers defined in the cartridge body include a central syringe tube 113 and multiple internal chambers 114. The chambers are open at the top such that one or more reagents and/or processing agents can be inserted in one or more select chambers before applying the film seal assembly atop the cartridge body. The chambers are surrounded by continuous top edges of the cartridge body 110 so that sealing of a planar film seal along the top edges seals the planar film over the various chambers. In some embodiments, the planar film seal assembly is configured to seal a majority of chambers, but leave one or more chambers accessible (e.g. one reagent chamber, sample chamber) to allow an end user to insert the fluid sample and/or a special reagent as desired. The living hinge 121 between the lid 120 and cartridge body 110 allows the lid to be flipped over to the closed position. The lid and cartridge include corresponding coupling features to secure the lid in the closed position. As shown, the underside of the lid includes a resilient tab 122 on opposing lateral sides that extend downwards when the lid is in the closed position. The resilient tabs 122 are received along a corresponding contour 112 (e.g., a recess or lip) that is contoured to fittingly receive the resilient tab to couple the lid to the cartridge body by a snap-fit connection. It is appreciated that while a snap-fit feature is described here, various other coupling features could be used.

FIG. 4B shows the same top view as in FIG. 4B but with a film seal applied, the one or more reagents having previously been deposited in one or more select chambers. As shown, the top layer of the film seal assembly has already been removed by the user so that only the bottom layer 132 is visible. This bottom layer 132 includes multiple vent openings 133 that align with the respective chambers. The bottom layer can further include a larger access opening 134, disposed over the sample chamber, which allows the end user to insert the fluid sample to be analyzed. The bottom layer can further include a central valve perforation 135 (e.g., criss-cross perforation or slit) to allow passage of an automated plunger/syringe of the instrument in the module to control fluid flow through the sample cartridge during processing.

FIGS. 5A-5B illustrate an alternative embodiment of a sample cartridge with a single lid that can be used with the improved film seal assemblies described herein. The single lid is configured to fit atop a separate cartridge body 110', as shown in FIG. 5C. In this embodiment, the cartridge body 110' can be a standalone cartridge body without a lid, and the single lid 120' component can be a separate component that is placed atop the cartridge body and coupled thereto. The lid is still relatively simple, the same or similar to that in FIG. 4A, such that this design retains some of the same benefits and advantages over the conventional double-lid as discussed above. In this embodiment, the lid and cartridge body include the same snap-fit features 112, 122 as discussed above. Similarly the lid can include the forward tab and central hole such that the lid operates in a similar manner as the integrated lid. One advantage of this approach is that the lid can be constructed of a differing material from the cartridge body, which may further reduce cost burden. Similar to the previous embodiment, one or more reagents and/or processing agents are deposited in select chambers of the cartridge body, then the film assembly is permanently welded (e.g. by heat sealing, such as by use of a laser, heat element, or any suitable approach) to seal the reagents within the cartridge, after which the cartridges is stored and ultimately sent to the end user, who then removes the liner to vent the reagent chambers and inserts the fluid sample in the sample chamber for processing and testing.

B. Example Film Seal Assemblies

Figure 6:
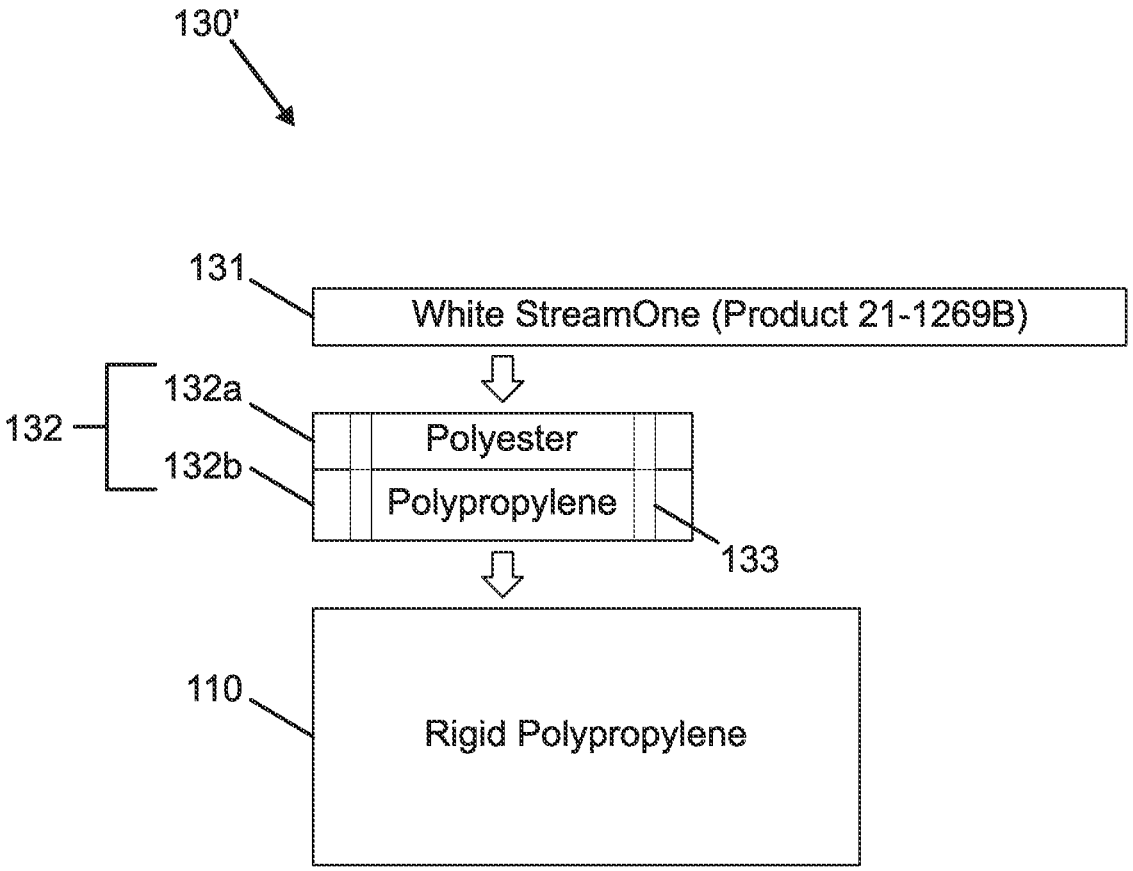
FIG. 6 shows a schematic of an improved film seal assembly in accordance with some embodiments.

FIG. 6 shows a schematic of an improved film seal assembly 130' in accordance with some embodiments. This schematic is consistent with the two-layer approach described in FIG. 1. As discussed, this film seal assembly design seals the reagents in the cartridge and allows use of a cartridge having a single lid. As shown, the assembly is a two-layer assembly that includes a peelable top layer 131 disposed atop a bottom layer 132 (i.e. lock/weld layer). The bottom layer 132 welds (e.g. permanently seals) to the top of the cartridge body 110. The bottom layer 132 includes perforations or openings (i.e. vent holes) to allow venting of the various chambers of the cartridge and can further include an access opening to the sample chamber for insertion of the sample. The peelable layer 131 is sealed by heat and/or adhesive atop the lock/weld layer so as to hermetically seal the openings in the lock/weld seal film layer, thereby hermetically sealing the reagents within the chambers while the cartridge is stored and shipped to the end user. The peelable top layer can further include one or more tabs by which the end user can peel away the layer, thereby exposing the vent holes in preparation for filling the sample chamber with fluid sample and performing sample testing with the cartridge.

In this embodiment, the peelable layer 131 can be made of a polymer film that can be heat sealed atop the lock/weld layer 132 to form the hermetic seal. In some embodiments, the peelable layer 131 is made from a polymer, such as polyester and can include a thin adhesive layer consisting of a polyester film with a sealant layer. The bottom layer 132 can be formed of one or more sub-layers. In the embodiment shown, layer 132 is formed of two layers, a polyester layer 132*a* disposed atop a polypropylene layer 132*b*. The polypropylene layer 132*b* is better suited for permanently locking/sealing (e.g. welding) to the rigid polypropylene cartridge by heat sealing, while the polyester layer 132*a* is better suited for releasably sealing with the top peelable layer 131. While certain materials are described above, it is appreciated that the above layers can be fabricated from any suitable material and can include additional intervening layers of same or differing materials.

As shown, the bottom lock/weld layer 132 includes vent openings 133 extending therethrough that are aligned over the reagent chamber for venting purposes. The top layer 131 does not include these vent opening such that when releasably sealed atop the bottom layer, the top layer hermetically seals the vent openings and reagents within the cartridge body. Once the top layer is removed by the end user, the reagent chambers are vented to facilitate fluid flow through the sample chamber.

Figure 7A:
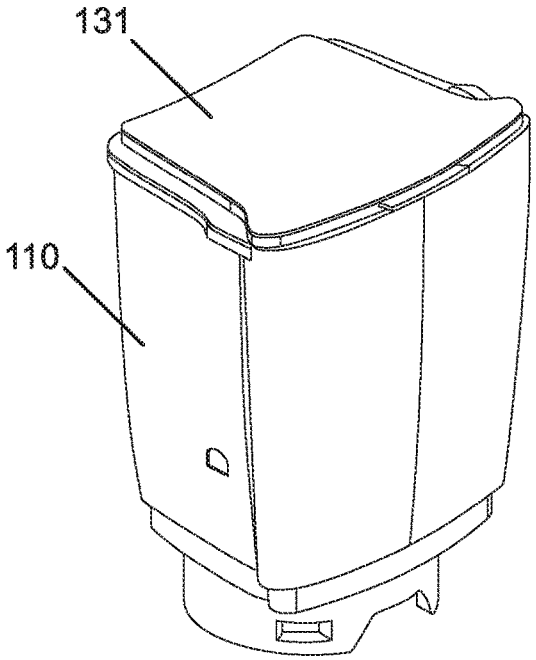
FIGS. 7A and 7B show a front perspective view of an assay cartridge body having an improved film seal assembly, shown before and after peeling away of a top liner of the film seal assembly, in accordance with some embodiments.
Figure 7B:
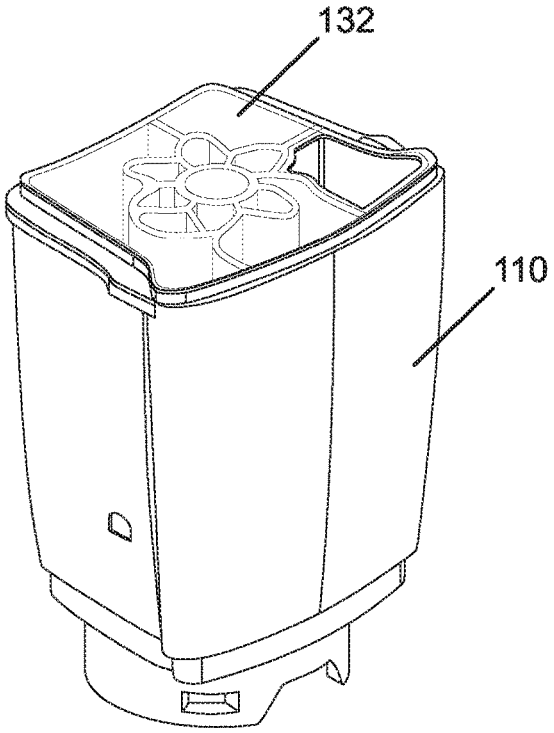
Figure 8A:
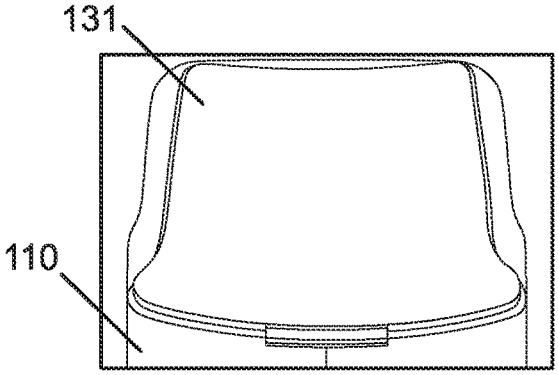
FIGS. 8A and 8B show a front perspective view of the assay cartridge and film seal assembly shown in FIGS. 7A-7B, shown before and after peeling away of a top liner of the film seal assembly, in accordance with some embodiments.
Figure 8B:
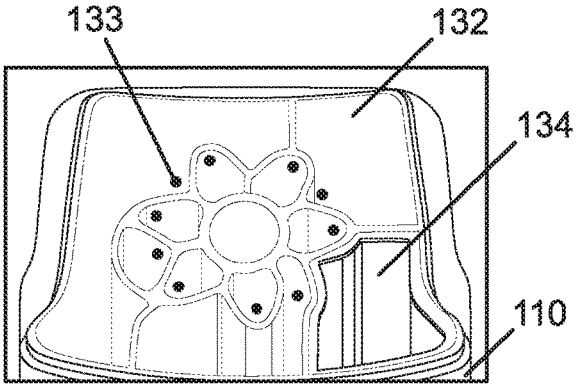

FIGS. 7A and 7B show a front perspective view of an assay cartridge body 110 having an improved film seal assembly such as that shown in FIG. 6, shown before and after peeling away of the top peelable layer. In FIG. 7A, the film seal assembly includes the top layer 131 hermetically sealing the reagent within the cartridge. In FIG. 7B, the user has removed the peelable top layer, thereby exposing the bottom layer 132 having vent openings and a large access opening for insertion of the fluid sample. FIGS. 8A and 8B show front perspective views of the same assay cartridge body and film seal assembly, shown before and after peeling away of the top peelable layer by the user. In FIG. 8B, the bottom layer 132 can further include a larger access opening 134, disposed over the sample chamber, which allows the end user to insert the fluid sample to be analyzed. It is appreciated that the film seal assembly can include various other layers and features in addition to those described above. In some embodiments, the cartridge can utilize the peelable layer without requiring any rigid lid component disposed thereon.

Figure 9A:
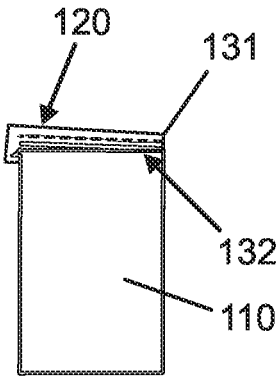
FIGS. 9A-9B show a two-layer film seal assembly in accordance with some embodiments.
Figure 9B:
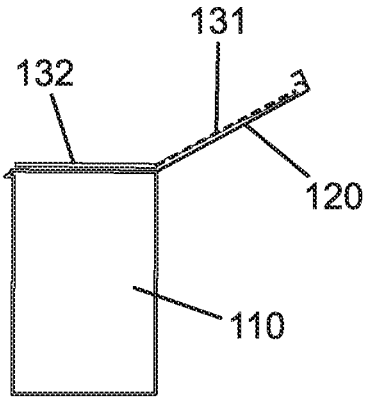

FIGS. 9A-9B show an alternative embodiment of a two-layer film seal assembly. Similar to the embodiment in FIG. 6, the film seal assembly 130' includes at least two layers, a bottom lock/weld layer 132 that permanently seals atop the cartridge body, and a top peelable layer 131 that forms a hermetic seal over the vent holes in the lock/weld layer. In this embodiment, however, the top peelable layer further includes a means by which to attach to the lid, such that opening the lid peels away the top peelable layer, as shown at right. In some embodiments, the top peelable layer includes a double sealant layer, for example, a bottom layer that releasably seals to the lock/weld layer and a top layer that locks/welds to the lid. In some embodiments, the top peelable layer 131 is constructed by multiple layer in reverse order as the configuration of the lock/weld layer 132.

Figure 10:
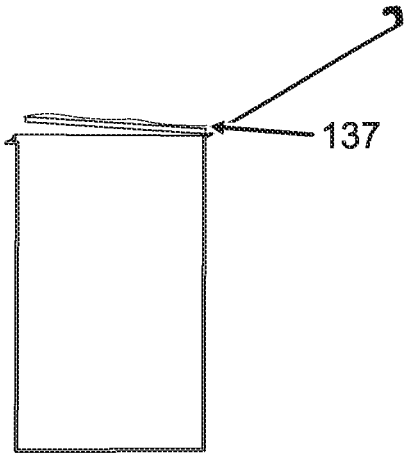
FIG. 10 shows a single layer film seal assembly in accordance with some embodiments.

FIG. 10 shows an alternative embodiment having a single layer film seal assembly 137. In this embodiment, the film seal assembly is a single layer, which may include one or more non-separable sub-layers integrated within the single layer. The single layer can include a bottom surface that permanently seals atop the cartridge body, such as by heat sealing, induction sealing, weld sealing, and/or adhesive sealing, and a top surface that releasably seals with the cartridge lid, thereby hermetically sealing the reagents within the cartridge with the lid in the closed position and releasing the hermetic seal and venting the chambers once the lid is opened by the end user. In some embodiments, this can be achieved by differing types of adhesive applied on the top and/or bottom of the single layer. In other embodiments, this can be achieved by forming the single layer from one or more sub-layers, for example, a polypropylene bottom layer that locks/welds with the cartridge body when heat sealed and a polyester top layer with an adhesive that releasably seals (e.g. by heat sealing and/or pressure sensitive) to the lid.

Figure 11A:
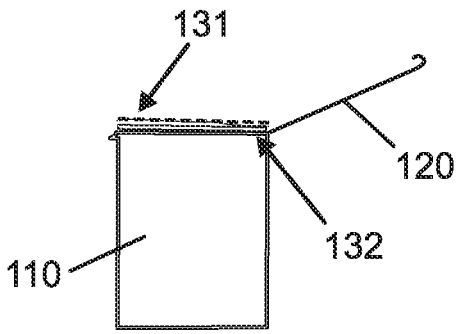
FIGS. 11A-11B shows a two layer film seal assembly having tabs and molded lid in accordance with some embodiments.
Figure 11B:
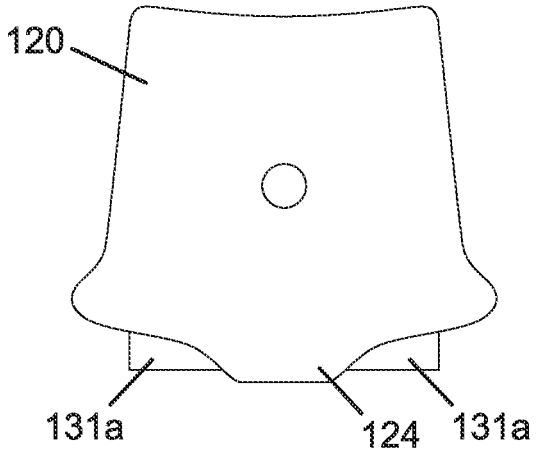
Figure 11C:
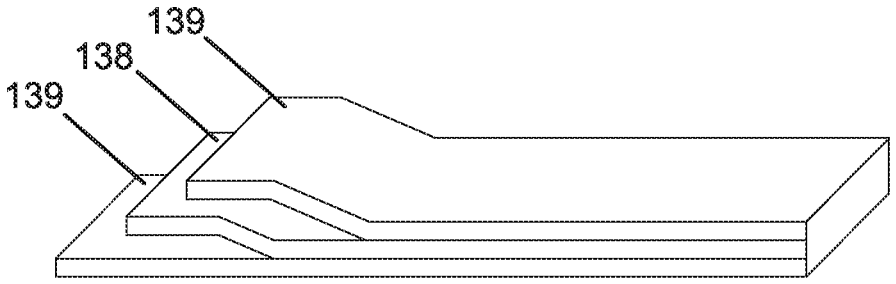
FIG. 11C shows an exemplary adhesive layer construction before assembly, in accordance with some embodiments FIG. 12 show a method of assembly a diagnostic assay cartridge utilizing an improved film seal assembly, in accordance with some embodiments.

FIGS. 11A-11B shows an alternative embodiment of a two layer film seal assembly with molded lid. In this embodiment, the film seal assembly includes a top peelable layer 131 disposed atop a bottom lock/weld layer 132. Similar to the embodiment in FIG. 7A, the bottom layer permanently seals atop the cartridge body and includes vent openings and sample insertion access, while the top peelable layer hermetically seals the vent openings during storage and transit to the end user. In this embodiment, the top layer 131 includes one or more forward extending tabs 131*a* by which the user can remove the liner. As shown, the lid also includes a forward extending tab 124 such that the user can grasp both the lid tab and the liner tab and open the lid and release the liner in one manual movement. In some embodiments, the liner tab can be attached (e.g. by adhesive or tacking) to facilitate a simplified work flow in opening the lid and removing the liner at the same time.

Figure 12:
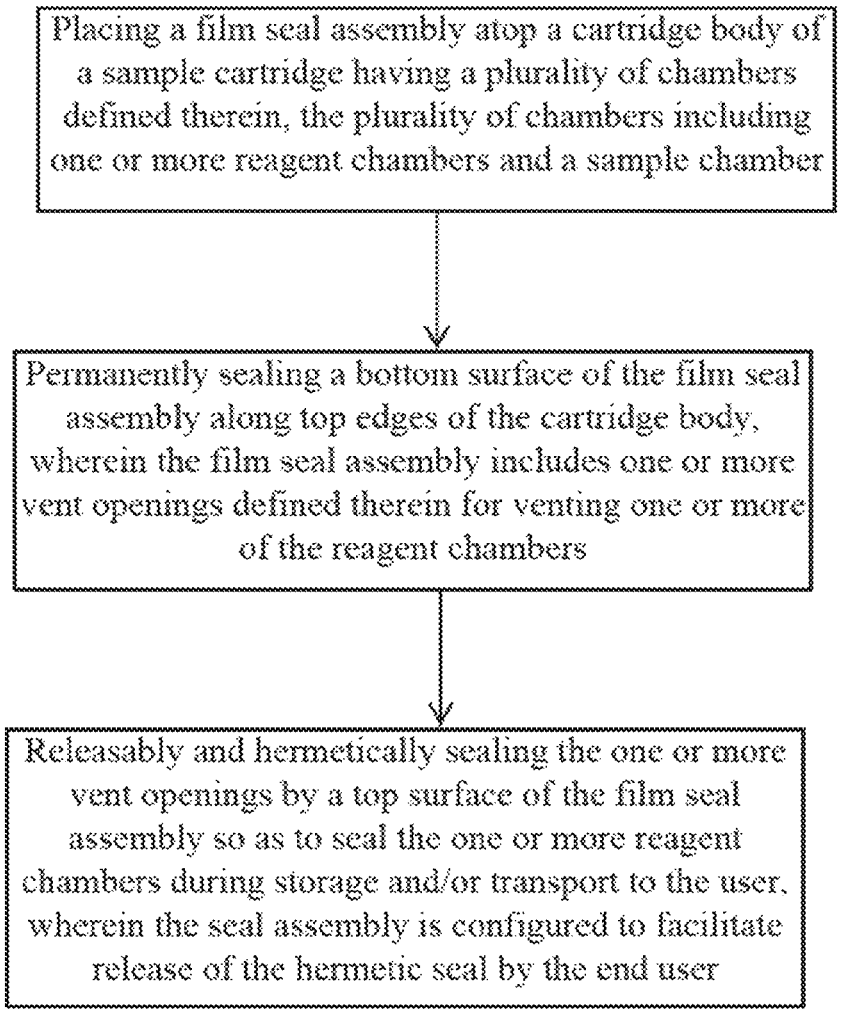

FIG. 12 shows an example method of sealing a sample cartridge utilizing a film seal assembly as described herein. As shown, the method of sealing can include steps of: placing a film seal assembly atop a cartridge body of a sample cartridge having chambers defined therein, the chambers including one or more reagent chambers and a sample chamber; permanently sealing a bottom surface of the film seal assembly along top edges of the cartridge body, where the film seal assembly includes one or more vent openings defined therein for venting one or more of the reagent chambers; and releasably and hermetically sealing the one or more vent openings by a top surface of the film seal assembly so as to seal the one or more reagent chambers during storage and/or transport to the user, where the seal assembly is configured to facilitate release of the hermetic seal by the end user. In some embodiments, the cartridge body can include multiple interfacing components, such as an inner and outer chamber, each of the inner and outer chambers having one or more sub-chambers for containing liquids and fluid sample, such cartridges are described in U.S. Patent Application No. US2022/0410150, the entire contents of which are incorporated herein by reference for all purposes. In such embodiments, the cartridge body can include multiple film seals, for example a first film seal having one or more layers that seal atop the inner chamber thereby sealing the sub-chambers, and a second film seal having one or more layers that seal atop the outer chamber, thereby sealing the one or more chambers therein. Any of the film seal concepts described herein can be applied to one or both of the inner and outer chambers of such cartridges.

Figure 13:
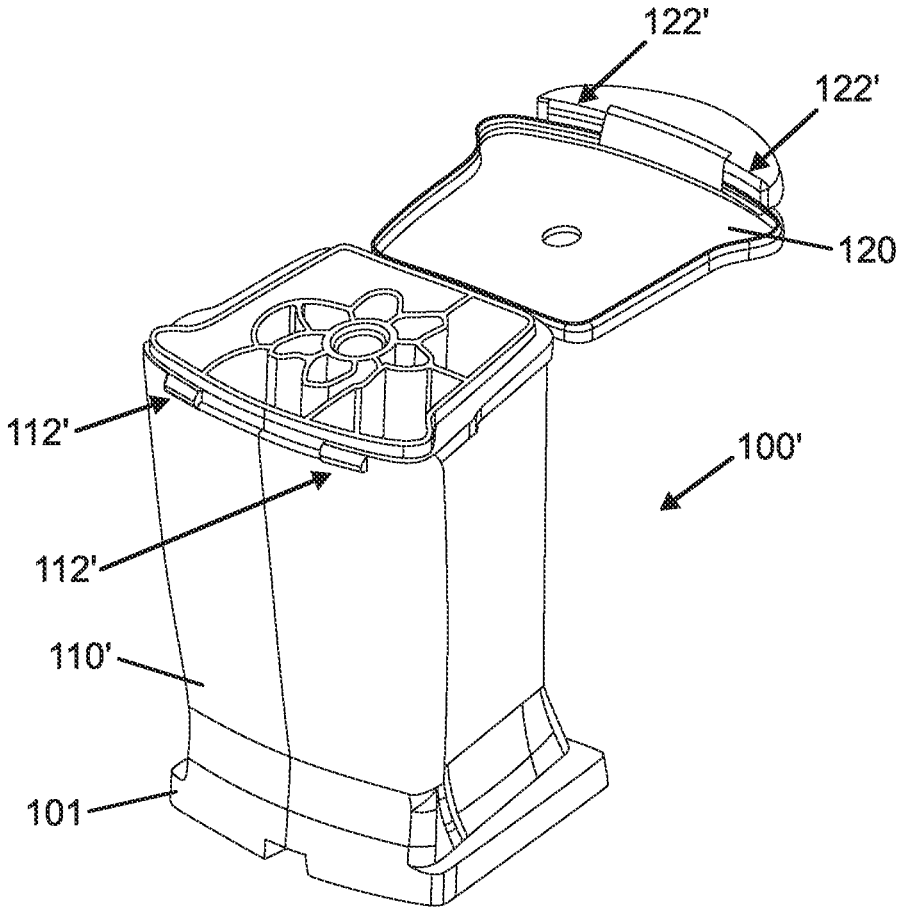
FIG. 13 shows an alternative unitary cartridge design with integral lid, in accordance with some embodiments.

FIG. 13 depicts another design of a unitary cartridge 100' that includes the cartridge body 110' with integral base 101 and lid 120. As in previous embodiments, the lid 120 and top of the cartridge body 110' include corresponding snap-features, except in this embodiment, the lid 120 includes two contoured undercuts 122' and the top edge of the cartridge body includes two corresponding resilient tabs 112' that snap into the undercuts of the lid when closed thereby securing the lid.

Figure 14:
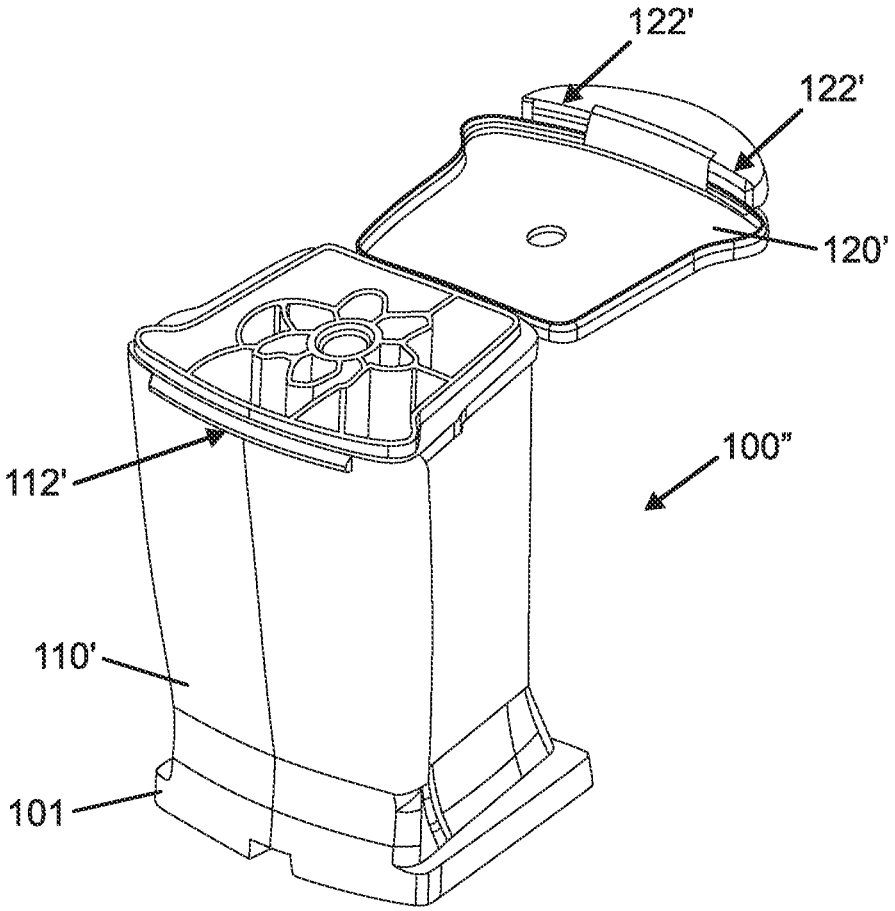
FIG. 14 shows an alternative unitary cartridge design with integral lid and snap-fit features, in accordance with some embodiments.

FIG. 14 depicts another design of a unitary cartridge 100" that includes cartridge body 110" with integral base 101 and lid 120. As in previous embodiments, the lid 120 and top of the cartridge body 110" include corresponding snap-features, except in this embodiment, the lid 120' includes two contoured undercuts 122' and the top edge of the cartridge body includes a single corresponding resilient tab 112' extending from the front top edge of the cartridge that snap into the undercuts of lid when closed thereby securing the lid. It is appreciated the unitary cartridge body described herein encompasses cartridges of differing dimensions and shapes.

In the foregoing specification, the invention is described with reference to specific embodiments thereof, but those skilled in the art will recognize that the invention is not limited thereto. Various features, embodiments and aspects of the above-described invention can be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art. Any references to publication, patents, or patent applications are incorporated herein by reference in their entirety for all purposes.

What is claimed is:

1. A method of sealing a sample cartridge, the method comprising: placing a film seal assembly atop a cartridge body of a sample cartridge having a plurality of chambers defined therein, the plurality of chambers including one or more reagent chambers and a sample chamber;

permanently sealing a bottom layer of the film seal assembly along top edges of the cartridge body, wherein the film seal assembly includes one or more vent openings defined the bottom layer for venting one or more of the reagent chambers; and releasably and hermetically sealing the one or more vent openings by a top layer of the film seal assembly to seal the one or more reagent chambers during storage and/or transport to the user, wherein the top layer is bonded to a single lid of the sample cartridge, wherein when a user opens the cartridge, the top layer peels off from the bottom layer of the film seal assembly, and wherein the seal assembly is configured to facilitate release of the hermetic seal by the end user.

2. The method of claim 1 wherein the top layer is bonded to the single lid of the sample cartridge by an adhesive layer.

3. The method of claim 1 wherein permanently sealing comprises heat sealing the bottom layer of the film seal assembly along a top edge of the cartridge body circumscribing the one or more reagent chambers.

4. The method of claim 1 further comprising: securing a single lid of the sample cartridge atop the film seal assembly, wherein the single lid is removable and/or movable between an open and closed position in which the single lid is secured atop the film assembly.

5. The method of claim 1 wherein the lid is integrally formed with the cartridge body, and securing the single lid comprises snapping corresponding snap-fit features of the lid and cartridge body.

6. The method of claim 5 wherein the snap-fit features comprise a resilient tabs projecting from the cartridge body that resiliently snaps with one or more corresponding undercut contours defined along the front edge of the lid.

7. The method of claim 4 wherein the single lid is integrally formed with the cartridge body.

8. The method of claim 7 wherein the entire cartridge body including the single lid is integrally formed as a unitary component.

9. The method of claim 4 wherein the single lid is a separate component from the cartridge body and is releasably coupled to the cartridge body.

10. The method of claim 4 wherein the single lid is releasably coupled to the cartridge body by corresponding snap-fit features.

11. The method of claim 1 wherein providing a releasable hermetic seal comprises heat sealing and/or adhesively sealing the top layer to the bottom layer.

12. The method of claim 1 wherein the top layer is an adhesive liner comprising polyester.

13. The method of claim 1 wherein the top layer includes one or more tabs that extend forward beyond a perimeter of the top of the cartridge body to facilitate manual grasping by the user to remove the liner.

14. The method of claim 13 wherein the film seal assembly includes an adhesive layer for sealing to the lid, wherein the adhesive layer is disposed atop the top layer and extends along the one or more tabs to facilitate manual grasping by the user to peel away the top layer.

15. The method of claim 13 wherein the single lid is releasably coupled atop the cartridge body with the film seal assembly in between, and wherein the single lid includes a front tab that extends beyond the perimeter of the top of the cartridge body to facilitate manual grasping by the user to remove the liner while opening the singe lid.

16. The method of claim 1 wherein the bottom layer comprises one or more sub-layers.

17. The method of claim 16 wherein the bottom layer comprises at least a bottom-most sub-layer comprising polypropylene for permanently heat sealing to the cartridge body, wherein the cartridge body is formed of rigid polypropylene.

18. The method of claim 17 wherein the bottom layer comprises a top-most layer comprising polyester for releasably sealing to the top layer.

19. The method of claim 1 wherein the film seal assembly comprises a single layer, wherein the top surface releasably seals with a lid of the sample cartridge and the bottom layer is configured to permanently seal with the cartridge body.

20. The method of claim 19 wherein the single layer comprises one or more adhesives disposed thereon.

21. The method of claim 1 wherein the single layer comprises at least two non-separable sub-layers, wherein the bottom layer comprises a first material for permanently heat sealing to the cartridge body and the top sub-layer comprises a second material different than the first, the second material selected for releasably sealing to a lid of the sample cartridge.

22. The method of claim 1 wherein the top layer is releasably sealed by applying pressure to the lid so that a pressure-sensitive adhesive disposed on the top layer hermetically seals the lid to the top layer of the assembly.

23. The method of claim 1 wherein the top layer is configured to releasably seal by heat sealing.

24. The method of claim 1 wherein the top layer is configured to releasably seal by any of: induction sealing, weld sealing, and/or adhesive sealing.

* * * * *